United States Patent [19]

Christy et al.

[11] Patent Number: 4,925,172

[45] Date of Patent: May 15, 1990

[54] SMALL INEXPENSIVE FINISHER

[75] Inventors: Kenneth G. Christy, Webster; Thomas F. Cooper, Farmington; Richard Dastin, Fairport, all of N.Y.

[73] Assignee: Xerox Corporation, Stamford, Conn.

[21] Appl. No.: 264,562

[22] Filed: Oct. 31, 1988

[51] Int. Cl.[5] ..... B42B 2/00

[52] U.S. Cl. ..... 270/53; 271/222

[58] Field of Search ..... 270/37, 53, 58; 271/220–222

[56] References Cited

U.S. PATENT DOCUMENTS

| | | | |
|---|---|---|---|
| 4,073,391 | 2/1978 | O'Brien et al. | 214/65 |
| 4,134,672 | 1/1979 | Burlew et al. | 355/14 |
| 4,227,275 | 10/1980 | Soderberg | 11/1 R |
| 4,248,413 | 2/1981 | Fox | 270/53 |
| 4,376,529 | 3/1983 | George et al. | 270/53 |
| 4,424,963 | 1/1984 | Bartholet et al. | 270/53 |
| 4,497,478 | 2/1985 | Reschenhofer et al. | 270/53 |
| 4,512,565 | 4/1985 | Matsumoto | 271/220 |
| 4,595,187 | 1/1986 | Bober | 270/37 |
| 4,603,971 | 8/1986 | Kukucka et al. | 270/53 |
| 4,605,211 | 8/1986 | Sonobe | 270/58 |
| 4,801,133 | 1/1989 | Ishiguro | 270/53 |

FOREIGN PATENT DOCUMENTS

| | | | |
|---|---|---|---|
| 62-269852 | 11/1987 | Japan | 270/53 |

OTHER PUBLICATIONS

IBM Technical Disclosure Bulletin, "Sheet Receiving Tray", by Wing, vol. 17, No. 4, Sep. 1974.

*Primary Examiner*—Robert E. Garrett
*Assistant Examiner*—Therese M. Newholm
*Attorney, Agent, or Firm*—William A. Henry, II

[57] ABSTRACT

A low-cost finisher that creates stapled books includes a tray that is tilted at an acute angle backward and away from the direction of incoming copy sheets. Copy sheets are fed into and slide down the copy sheet support surface of the tray and against a rear registration wall of the tray under the influence of tampers. Another tamper forces the copy sheets against a side registration guide of the tray to align them in the head of a stapler. Stapled books are transported out of the tray to a catch tray.

11 Claims, 3 Drawing Sheets

SMALL INEXPENSIVE FINISHER

The present invention relates to an apparatus that receives copies from a conveyor of a copier or printer, registers the copies in sets adjacent a stapler and forwards the now stapled sets toward an output tray. More particularly, the invention concerns a small and inexpensive finisher apparatus that furnishes finished copy sheet sets to an output tray.

A number of attempts at stapling copy sheets supplied by a copier have been made, e.g. U.S. Pat. No. 4,073,391 discloses a sheet jogger used to justify and align a stack of sheets into a bundle which may be stapled if desired. The jogging apparatus contains two spaced rollers fixed to a roller shaft and extended partially through and above a supporting means. In addition, a staple anvil is affixed to the lower end of the right side of the jogger. In U.S. Pat. No. 4,134,672 a copier finisher is shown for assembling, stapling if desired and stacking copies in an offset or straight manner in an output tray. The finisher includes an inclined copy assembly tray and a stapler mounted above the tray which is activated by a pressure bar. U.S. Pat. No. 4,227,275 discloses a device for arranging, aligning and stapling a set of papers. A continuously vibrating shaker table is provided, which forms an angle of between approximately 45° and 90° with a horizontal plane. The shaker table contains a field belt which transports the paper sheets into a stapler disposed in the lower right-hand corner of the device. A compact single bin finisher is disclosed in U.S. Pat. No. 4,424,963 that accumulates a set of documents and staples them to form booklets. The accumulation means and stapler are arranged in an offset position relative to an output tray. In U.S. Pat. No. 4,497,478, a copy sorting apparatus is shown for squaring, stapling and stacking copy sets. The apparatus includes a housing unit, located adjacent to a copier, which includes an upper plate downwardly inclined from the copier to receive copies and a fixed desk-type stapler adjacent to the upper plate. A saddle stapler is shown in U.S. Pat. No. 4,595,187 for use with an electrophotographic printing machine. Side registered copies are centrally creased, stapled in two positions and forwarded to a stacking tray. U.S. Pat. No. 4,375,529 is directed to a finisher apparatus for the collecting and sorting of individual sheet of a multipage original set, corner registering of the sets and binding of the sets as by stapling. These finishers were not entirely satisfactory, mainly because of their size, complexity and cost.

Accordingly, disclosed herein is a low-cost finisher for small copiers that creates stapled books. Sheets are fed into and slide down a tilted tray where they are tamped against a rear registration edge by two simple spring tampers, a side tamper forces the sheets into side registration and into the mouth of the stapler. The sheets are stapled and transported to an output tray. In an alternative embodiment, the lead edge of the sheets are tamped by a single unitary spring.

While the present invention will hereinafter be described in connection with a preferred embodiment thereof, it will be understood that it is not intended to limit the invention to that embodiment. On the contrary, it is intended to cover all alternatives, modifications, and equivalents that may be included within the spirit and scope of the invention as defined by the appended claims.

For a general understanding of the features of the present invention, reference is made to the drawings. In the drawings, like reference numerals have been used throughout to designate identical elements.

Figure 1:
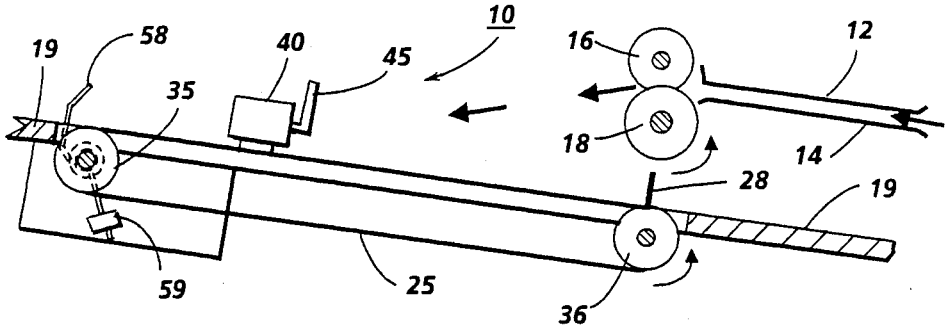
FIG. 1 is an elevational view of the compact finisher in accordance with the present invention.
Figure 2:
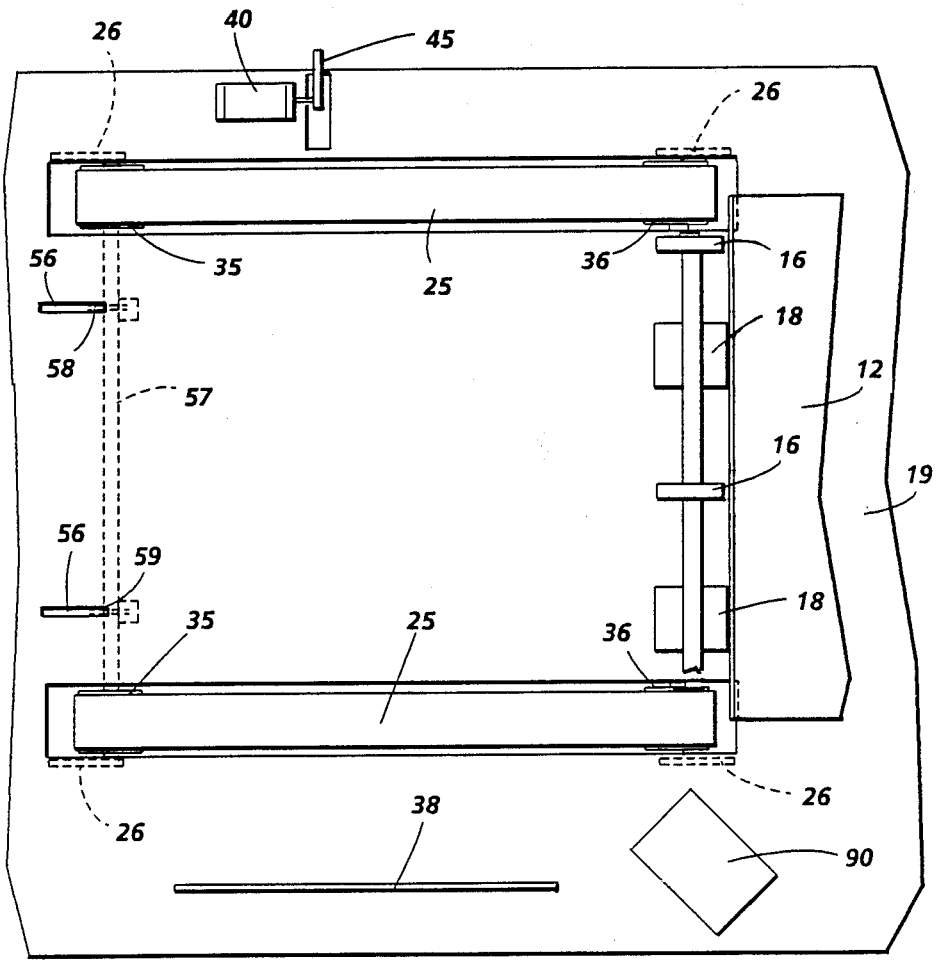
FIG. 2 is a partial exploded plan view of the finisher of FIG. 1.

Turning now to FIG. 1, small inexpensive finisher 10 accepts individual and separate copy sheets from a conventional printer/copier (not shown), staples them into individual copy sheet sets and forwards each set for compiling at a separate location. Finisher 10 accepts the first sheet from a printer/copier through guide baffles 12 and 14 into and through a set of soft nip rolls 16 and 18 that both corrugate the sheet and direct it down due to a 6° angle built into the rolls. As the sheet enters the tray it is under a center guide (not shown) which helps keep curl under control. The sheet then comes into contact with two down hill registration fingers or spring members 58 which are mounted on shaft 57 and balanced in an upright position by counter weight 58. The incoming sheet biases the registration fingers backwards as it enters the tray and once the momentum of the incoming sheet dissipates the spring bias of fingers 58 pushes the sheet backwards against rear registration edge 28. Rotating solenoid 40 is then energized, tamping the sheet over about 1.5 inches against side registration edge 38 with arm 45 to the mouth of or head of conventional stapler 90. This action continues until the set number of pages have been compiled in the stapler head. The stapler is then energized and the copy sheet set is stapled. While the next sheet of the next set begins to enter the finisher for the next book, belts 25 entrained over driven rolls 36 and idler rolls 35 are driven counter clockwise by a conventional motor to transport the finished book over support member 19 to a catch tray (not shown). As the belts are driven into spring members or fingers 58, the force of the sheet stack against the fingers propels the fingers into slots 56 and thereafter slides the sheet stack over the fingers now recessed within the slots. After the copy sheet set has passed slots 56, counter weight 59 and the resiliency of the springs causes the springs to emerge from the slots and swing into a sheet interfering position for biasing the next sheet of the following copy sheet set against registration edge 28.

Figure 3:
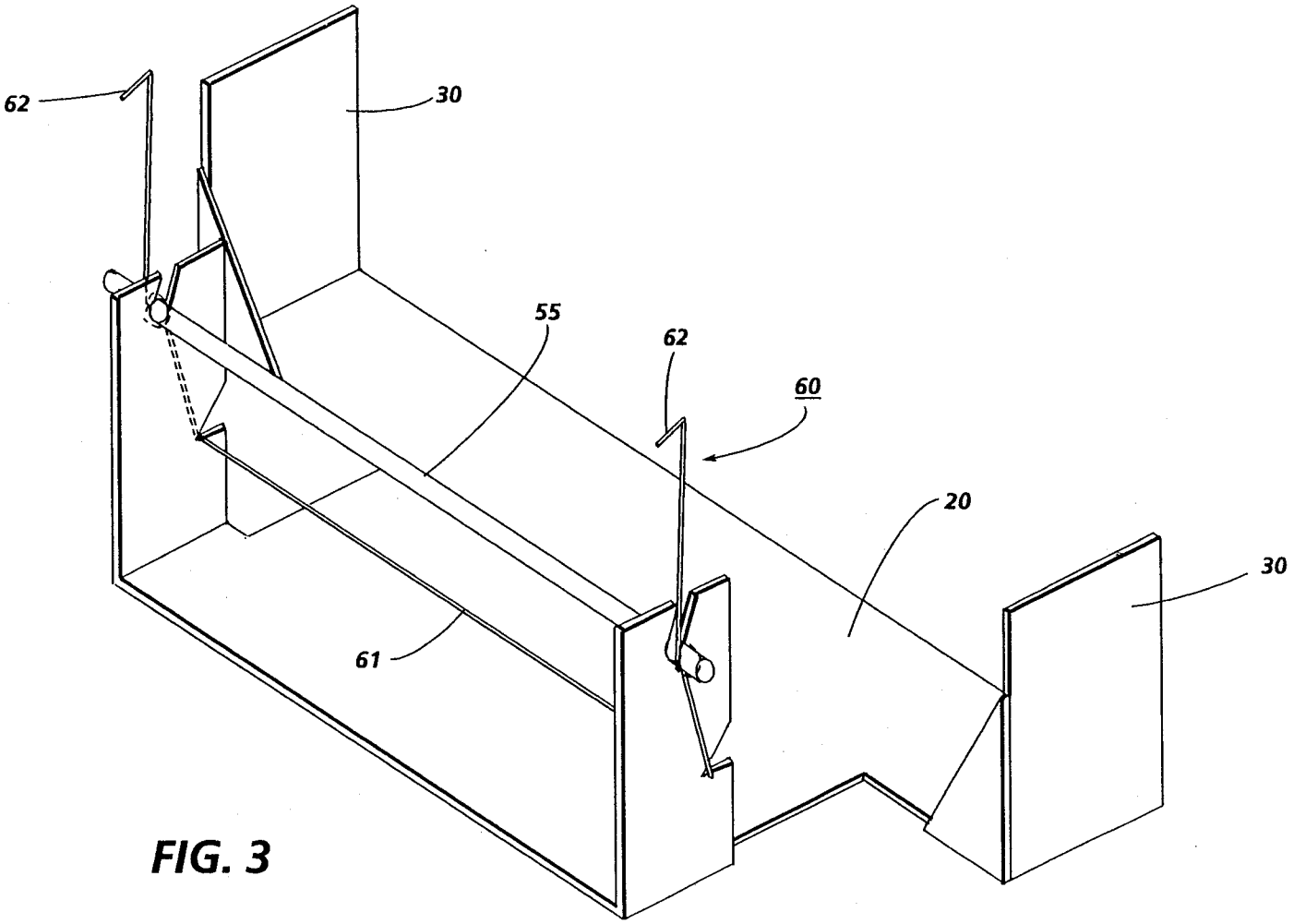
FIG. 3 is an isometric view of alternative embodiment of a down hill tamper finger useable in the apparatus of FIG. 1.
Figure 4:
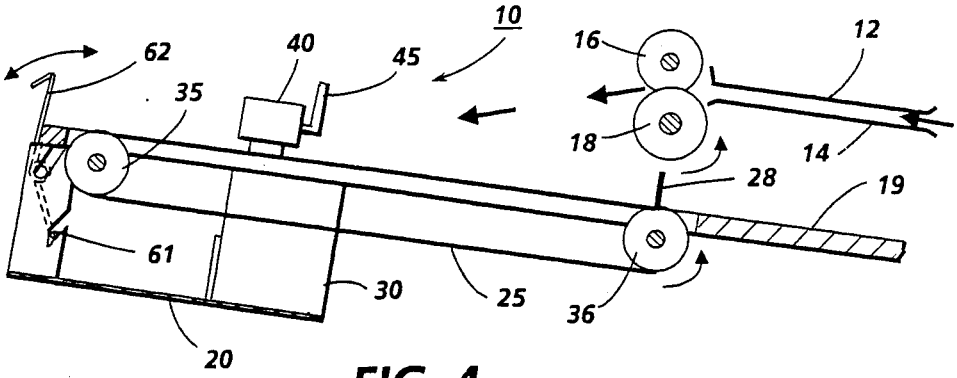
FIG. 4 is an elevational view of alternative embodiment showing the down hill tamper finger of FIG. 3 used in the apparatus of FIG. 1.
Figure 5:
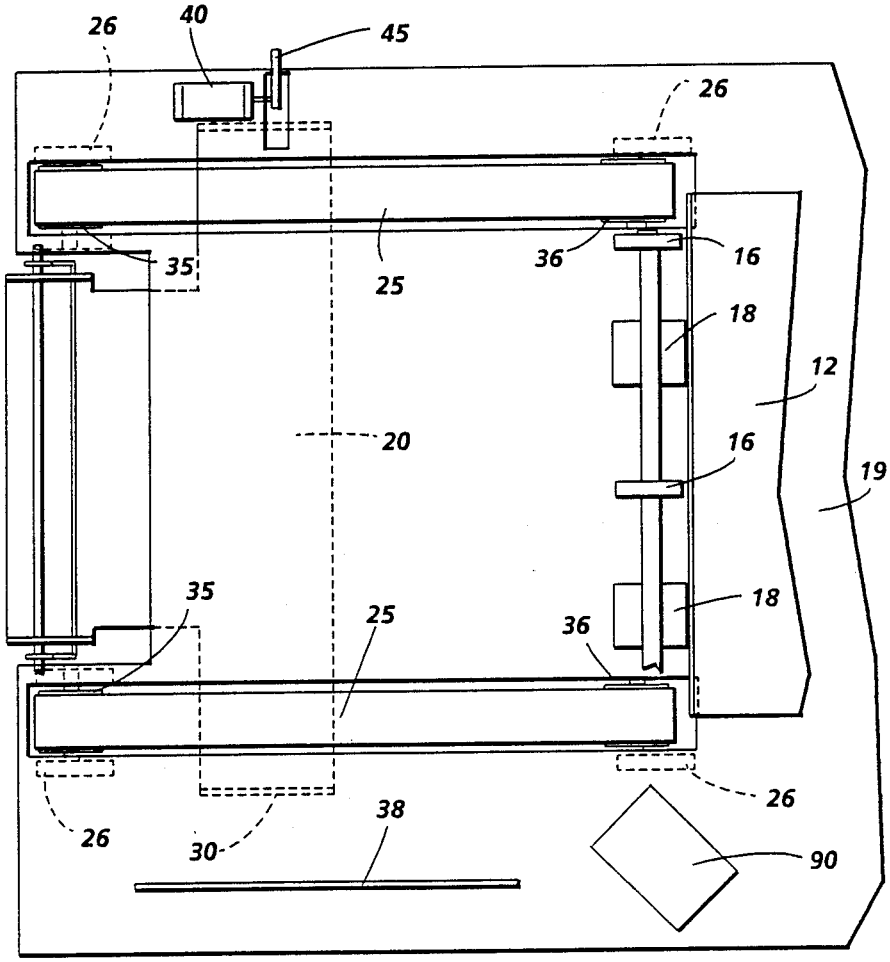
FIG. 5 is a partial exploded plan view of the finisher of FIG. 4.

An alternative embodiment of the invention is shown in FIGS. 3–5 that includes a one piece wire configured in a U-shaped such that portions of the wire are contacted by all copy sheets coming into finisher 10. As shown in FIG. 3, unitary wire 60 is wrapped around shaft 55 that is supported in a single piece sheet metal structure 20 having side members 30 that are adapted for positioning under the sheet support portion of finisher 10 as shown in FIGS. 4 and 5. A horizontal portion 61 of spring 60 rests in cut-outs of support structure 20 and serve as a counter balance for the upstanding fingers of spring 60. Once the support structure 20 is in place underneath the support surface of finisher 10 as shown in FIG. 4, fingers 62 are positioned in the path of incoming copy sheets and are deflected by the copy sheets toward a slot (not shown) in member 19 much the same way as spring 58 is deflected by copy sheets in FIG. 1. After each sheet leaves the corrugation nip formed between rollers 16 and 18, spring fingers 62 bias the sheets toward registration edge 28. Each sheet is also side registered against side registration edge 38 by side tamper members or arm 45 of solenoid 40. Afterwards, the now completed copy sheet set is stapled with stapler 90. While the first copy sheet of the next copy sheet set is being transported through the corrugation nip, rolls 36 are driven in a counter clockwise direction and thereby causes belts 25 to move the completed copy sheet set out of the finisher toward an output tray (not shown) and the process of end registering and side registering each copy sheet of the next copy sheet set commences. This process continues until the total number of copy sheet sets or books have been made.

It shall now be apparent that a low-cost finisher has been disclosed that creates stapled books. The finisher includes a tray that is tilted away from the sheet feed direction such that as sheets come into the tray they contact spring-like fingers that force the sheets backwards down the sheet support surface of and registered against a rear registration wall of the tray where they are then tamped against a side registration member to align them in the head of a stapler where they are stapled and subsequently transported by transport means within the tray out of the tray toward an output tray.

What is claimed is:

1. A finishing apparatus adapted to staple and transport compiled sheets therefrom, comprising: a tray positioned to receive copy sheets on a support surface thereof, said tray being tilted backwards at an acute angle in a downhill configuration with respect to the sheet feeding direction, skewed corrugation rolls positioned above and adapted to feed copy sheets into said tray, a plurality of resiliently biasable lead edge tamper members adapted to contact the lead edges of the copy sheets individually and be propelled by the sheets in the direction of movement of the sheets as the sheets enter said tray and subsequently drive the sheets in reverse to the sheet feed direction against a rear registration wall of said tray, stapler means positioned adjacent a corner of said tray formed by the intersection of said support surface and said rear wall for stapling the copy sheets, side tamper means for shifting each sheet individually into said stapler means so that a complete set of copy sheets can be stapled by said stapler means, and wherein said tray means includes drive means adapted to drive the stapled set of copy sheet out of said tray while the first sheet of the next set of copy sheet is being feed into said tray by said corrugation rolls.

2. The finishing apparatus of claim 1, wherein said plurality of tamper members that contact the lead edges of the copy sheets include wire means.

3. The finishing apparatus of claim 2, wherein said wire means are mounted on a shaft that support said drive means which transports stapled copy sheet sets away from said tray.

4. The finisher apparatus of claim 3, wherein said drive means which transports stapled copy sheet sets out of said tray includes drive rolls and idler rolls surrounded by belt means with said belt means being positioned within but slightly above the copy sheet support surface of said tray.

5. A finishing apparatus adapted to staple and transport compiled sheets therefrom, comprising: a tray positioned to receive copy sheets on a support surface thereof, said tray being tilted backwards at an acute angle in a downhill configuration with respect to the sheet feeding direction, skewed corrugation rolls positioned above and adapted to feed copy sheets into said tray, lead edge tamper means adapted to contact the lead edges of the copy sheets individually and be propelled by the sheets in the direction of movement of the sheets as the sheets enter said tray and subsequently the spring bias of said lead edge tamper means drives the sheets in reverse to the sheet feed direction against a rear registration wall of said tray, stapler means positioned adjacent a corner of said tray formed by the intersection of said support surface and said rear wall, side tamper means adapted to shift each sheet individually into said stapler means so that a complete set of copy sheets can be stapled by said stapler means, and wherein said tray means includes drive means adapted to drive the stapled set of copy sheet out of said tray while the first sheet of the next set of copy sheet is being feed into said tray by said corrugation rolls.

6. The finishing apparatus of claim 5, wherein said lead edge tamper means that contact the lead edges of the copy sheets include a single piece, integral wire means.

7. The finishing apparatus of claim 6, wherein said single piece, integral wire means is mounted on a separate shaft from said drive means which transports stapled copy sheet sets away from said tray.

8. The finishing apparatus of claim 7, wherein said single piece, integral wire means and said separate shaft are mounted on a single piece, unitary structure and wherein said single piece, unitary structure is positioned in mating relationship with said tray.

9. A finishing apparatus adapted to staple and transport compiled sheets therefrom, comprising: a tray positioned to receive copy sheets on a support surface thereof, said tray being tilted backwards at an acute angle in a downhill configuration with respect to the sheet feeding direction, skewed corrugation rolls positioned above and adapted to feed copy sheets into said tray, lead edge tamper means adapted to contact the lead edges of the copy sheets individually after they have left said corrugation rolls and drive the sheets in reverse to the sheet feed direction against a rear registration wall of said tray, stapler means positioned adjacent a corner of said tray formed by the intersection of said support surface and said rear wall, side tamper means adapted to shift each sheet individually into said stapler means so that a complete set of copy sheets can be stapled by said stapler means, and wherein said tray means includes drive means adapted to drive the stapled set of copy sheet out of said tray while the first sheet of the next set of copy sheet is being feed into said tray by said corrugation rolls, and slot means for receiving said lead edge tamper means once said drive means is actuated.

10. The finishing apparatus of claim 9, wherein said lead edge tamper means that contact the lead edges of the copy sheets is a U-shaped wire.

11. The finishing apparatus of claim 10, wherein said U-shaped wire is mounted on a separate shaft from said drive means which transports stapled copy sheet sets away from said tray.

* * * * *